US009297381B2

(12) United States Patent
Holbrook et al.

(10) Patent No.: US 9,297,381 B2
(45) Date of Patent: Mar. 29, 2016

(54) SWITCHABLE SINGLE-START OR MULTI-START SCROLL PUMP

(71) Applicant: Edwards Limited, Crawley, West Sussex (GB)

(72) Inventors: Alan Ernest Kinnaird Holbrook, Pulborough (GB); Miles Geoffery Hockliffe, Ringmer (GB)

(73) Assignee: Edwards Limited, Crawley (GB)

( * ) Notice: Subject to any disclaimer, the term of this patent is extended or adjusted under 35 U.S.C. 154(b) by 0 days.

(21) Appl. No.: 14/411,556

(22) PCT Filed: Jun. 10, 2013

(86) PCT No.: PCT/GB2013/051513

§ 371 (c)(1),
(2) Date: Dec. 29, 2014

(87) PCT Pub. No.: WO2014/006362

PCT Pub. Date: Jan. 9, 2014

(65) Prior Publication Data

US 2015/0192125 A1 Jul. 9, 2015

(30) Foreign Application Priority Data

Jul. 5, 2012 (GB) ..... 1211997.0

(51) Int. Cl.
*F01C 1/02* (2006.01)
*F03C 2/00* (2006.01)
(Continued)

(52) U.S. Cl.
CPC ..... *F04C 18/02* (2013.01); *F01C 1/0215* (2013.01); *F04C 18/0215* (2013.01);
(Continued)

(58) Field of Classification Search
CPC ..... F04C 18/0215; F04C 18/0246; F04C 18/0253; F04C 23/008; F04C 28/24; F04C 28/26; F01C 1/0215; F01C 1/0246
USPC ..... 418/6, 15, 55.1–55.6, 57, 270; 417/310, 417/440
See application file for complete search history.

(56) References Cited

U.S. PATENT DOCUMENTS 5,626,469 A * 5/1997 Schofield ..... 418/6
6,922,999 B2 * 8/2005 Kimura et al. ..... 418/6
(Continued)

FOREIGN PATENT DOCUMENTS

CN 1576603 A 2/2005
CN 101787977 A 7/2010
(Continued)

OTHER PUBLICATIONS

International Search Report dated Jul. 29, 2013 in the counterpart PCT Application No. PCT/GB2013/051513, 3 pgs.
Search Report under Section 17 mailed Nov. 6, 2012 in counterpart GB Application No. 1211997.0, 4 pgs.
First Office Action and Translation thereof dated Jul. 31, 2015 in counterpart CN Application No. 201380035940.8, 14 pgs.

*Primary Examiner* — Theresa Trieu
(74) *Attorney, Agent, or Firm* — Shumaker & Sieffert, P.A.

(57) ABSTRACT

The present invention is a scroll pump comprising two intermeshing scrolls arranged so that on relative orbital movement of the scrolls gas is pumped from an inlet to an outlet. The scrolls have a plurality of successive scroll wraps I, II, II, IV, V, VI between the inlet and the outlet. There is a single-start condition in which fluid is pumped from the inlet to the outlet along a single flow path extending through each of the scroll wraps in succession and a multi-start condition in which fluid is pumped from the inlet along a plurality of flow paths which extend in parallel through radially adjacent scroll wraps and converge to a single flow path prior to the outlet. A valve arrangement is operable for switching the scroll pump between the single-start and the multi-start conditions.

17 Claims, 7 Drawing Sheets

(51) Int. Cl.

| | |
|---|---|
| ***F03C 4/00*** | (2006.01) |
| ***F04C 2/00*** | (2006.01) |
| ***F04C 18/02*** | (2006.01) |
| ***F04C 28/06*** | (2006.01) |
| ***F04C 28/24*** | (2006.01) |
| *F04C 23/00* | (2006.01) |

(52) U.S. Cl.

CPC ..... *F04C 18/0246* (2013.01); *F04C 18/0253* (2013.01); *F04C 18/0261* (2013.01); *F04C 18/0269* (2013.01); *F04C 23/001* (2013.01); *F04C 28/06* (2013.01); *F04C 28/065* (2013.01); *F04C 28/24* (2013.01); *F04C 23/008* (2013.01)

(56) References Cited

U.S. PATENT DOCUMENTS

| | | | | |
|---|---|---|---|---|
| 7,537,440 | B2 * | 5/2009 | Goodwin et al. | 418/15 |
| 2005/0019177 | A1 | 1/2005 | Shin et al. | |
| 2011/0058972 | A1 | 3/2011 | Patel et al. | |
| 2012/0100026 | A1 * | 4/2012 | Stones et al. | 418/55.1 |

FOREIGN PATENT DOCUMENTS

| | | | |
|---|---|---|---|
| JP | 2004332556 | A | 11/2004 |
| JP | 2012092773 | A | 5/2012 |

* cited by examiner

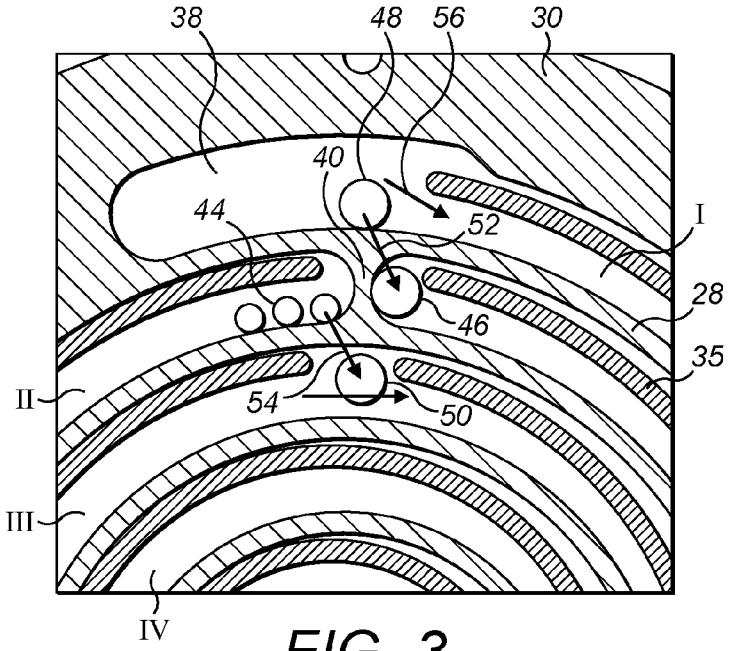
FIG. 3
FIG. 4
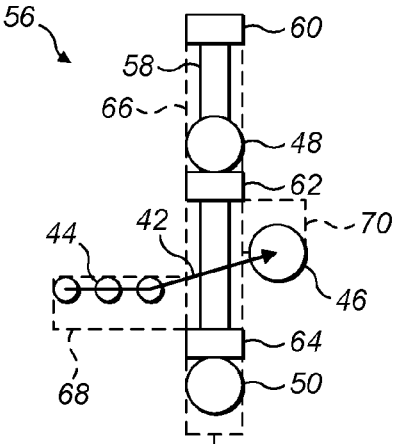
FIG. 5
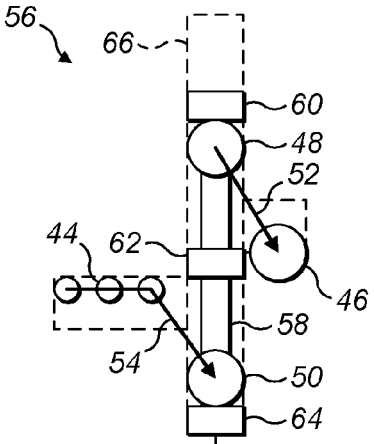
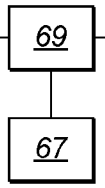

SWITCHABLE SINGLE-START OR MULTI-START SCROLL PUMP

This application is a national stage entry under 35 U.S.C. §371 of International Application No. PCT/GB2013/051513, filed Jun. 10, 2013, which claims the benefit of G.B. Application 1211997.0, filed Jul. 5, 2012. The entire contents of International Application No. PCT/GB2013/051513 and G.B. Application 1211997.0 are incorporated herein by reference.

TECHNICAL FIELD

The present invention relates to a scroll pump comprising two intermeshing scrolls arranged so that on relative orbital movement of the scrolls gas is pumped from an inlet to an outlet.

BACKGROUND

A prior art scroll compressor, or pump, 100 is shown in FIG. 8. The pump 100 comprises a pump housing 102 and a drive shaft 104 having an eccentric shaft portion 106. The shaft 104 is driven by a motor 108 and the eccentric shaft portion is connected to an orbiting scroll 110 so that during use rotation of the shaft imparts an orbiting motion to the orbiting scroll relative to a fixed scroll 112 for pumping fluid along a fluid flow path between a pump inlet 114 and pump outlet 116 of the compressor.

The fixed scroll 112 comprises a scroll wall 118 which extends perpendicularly to a generally circular base plate 120. The orbiting scroll 122 comprises a scroll wall 124 which extends perpendicularly to a generally circular base plate 126. The orbiting scroll wall 124 co-operates, or meshes, with the fixed scroll wall 118 during orbiting movement of the orbiting scroll. Relative orbital movement of the scrolls causes a volume of gas to be trapped between the scrolls and pumped from the inlet to the outlet.

A more detailed view of the scroll arrangement is shown in FIG. 9. In the Figure, the fixed scroll 112 is shown in hatching with the scroll plate 120 and the scroll 118, whilst the orbiting scroll is shown in bold with only the scroll wall 124. The scrolls have six successive scroll wraps I, II, III, IV, V, VI between the inlet 128 to the scroll arrangement and the outlet 130. The inlet 128 receives fluid from the pump inlet 114 and the outlet 130 conveys fluid to the pump outlet 116. During relative orbiting motion of the scrolls, fluid conveyed through the inlet 128 is trapped initially in pockets formed in the first wrap I. As the fluid is forced towards the outlet 130 the pockets are gradually compressed through successive wraps II, III, IV, V, VI. The arrangement shown in FIG. 9 is single-start meaning that there is a single generally spiral flow path which starts at the inlet and ends at the outlet.

FIG. 10 shows a double-start, or twin-start, arrangement. As with FIG. 9 the fixed scroll is hatched whereas the orbiting scroll is shown in bold.

Again, the scrolls have six successive scroll wraps I, II, III, IV, V, VI between the inlet 128 and the outlet 130. During relative orbiting motion of the scrolls, fluid conveyed through the inlet 128 is trapped initially in pockets formed in both the first wrap I and the second wrap II thereby forming two fluid flow paths starting at start points 132, 134. This fluid is forced along both flow paths and converges at convergence point 136 forming a single flow path from the convergence point to the outlet 130 through scroll wraps III, IV, V, VI. A multi-start arrangement is typically used when increased pumping capacity is required, that is when it is required that a greater volume of gas is pumped through the pump. Increased pumping capacity is achieved because fluid is pumped directly from the inlet 128 through two wraps I, II rather just a single wrap for a single-start arrangement. However, it will be appreciated that fewer wraps act as compression stages as compared to a single-start arrangement and therefore the ultimate pressure which can be achieved in a multi-start arrangement is less than with a single-start arrangement.

FIG. 11 is graph showing various characteristics of a single-start and a twin-start arrangement when evacuating a chamber initially at atmospheric pressure. The graph shows chamber pressure on the left axis, inverter output power on the right axis and elapsed time on the horizontal axis. Inverter output power is power consumed by the pump. There are four curves shown in the graph; power consumed 138 and chamber pressure 140 for a single start arrangement and power consumed 142 and chamber pressure 144 for a two-start arrangement. Power consumed is shown in broken lines and chamber pressure is shown in solid lines.

Looking first at the chamber pressure plots 140, 144 it will be seen as indicated above that after an initial pressure decrease to 100 mbar, which both single-start and two-start achieve at a similar rate, the two-start arrangement reduces pressure at a faster rate than the single-start arrangement. However, the single-start arrangement produces a lower ultimate pressure (0.005 mbar) than the ultimate pressure achieved by the two-start arrangement (0.01 mbar).

The power 142 consumed by the two-start arrangement is greater than that the power 138 consumed by the single-start arrangement over the initial period from 1000 mbar to 100 mbar, but subsequently the power consumed by the two-start arrangement is less than that consumed by the single-start arrangement.

Depending on the particular pressure regime required in a chamber evacuated by a vacuum pump, a pump with an appropriate configuration is selected. For example, if a low ultimate pressure is the most important characteristic, a single-start pump is used or if rate of pressure reduction is the most important characteristic a two-start pump is used.

Typically, the power consumption of a pump is reduced by limiting the inlet capacity or avoiding high compression ratios. A pressure relief valve is sometimes used in a two-start pump to reduce power consumption.

SUMMARY

The present invention provides a scroll pump comprising two intermeshing scrolls arranged so that on relative orbital movement of the scrolls gas is pumped from an inlet to an outlet, the scrolls having a plurality of successive scroll wraps between the inlet and the outlet, the scroll pump having a single-start condition in which fluid is pumped from the inlet to the outlet along a single flow path extending through each of the scroll wraps in succession and a multi-start condition in which fluid is pumped from the inlet along a plurality of flow paths which extend in parallel through radially adjacent scroll wraps and converge to a single flow path prior to the outlet, and a valve arrangement operable for switching the scroll pump between the single-start and the multi-start conditions.

The present invention also provides a scroll pump comprising two intermeshing scrolls arranged so that on relative orbital movement of the scrolls gas is pumped from an inlet to an outlet, the scrolls having a plurality of successive scroll wraps between the inlet and the outlet, the scroll pump having a first multi-start condition in which fluid is pumped from the inlet along a first plurality of flow paths which extend in parallel through radially adjacent scroll wraps and converge to a single flow path prior to the outlet and a second multi-start condition in which fluid is pumped from the inlet along a second plurality of flow paths which extend in parallel through radially adjacent scroll wraps and converge to a single flow path prior to the outlet, the number of starts in the first multi-start condition being different from the number of starts in the second multi-start condition, and a valve arrangement operable for switching the scroll pump between the first and the second multi-start conditions.

BRIEF DESCRIPTION OF DRAWINGS

In order that the present invention may be well understood, some embodiments thereof, which are given by way of example only, will now be described with reference to the accompanying drawings, in which:

FIGS. 2 and 3 show part of the scroll pump in more detail;

FIGS. 4 and 5 show a valve arrangement of the scroll pump;

DETAILED DESCRIPTION

Figure 1:
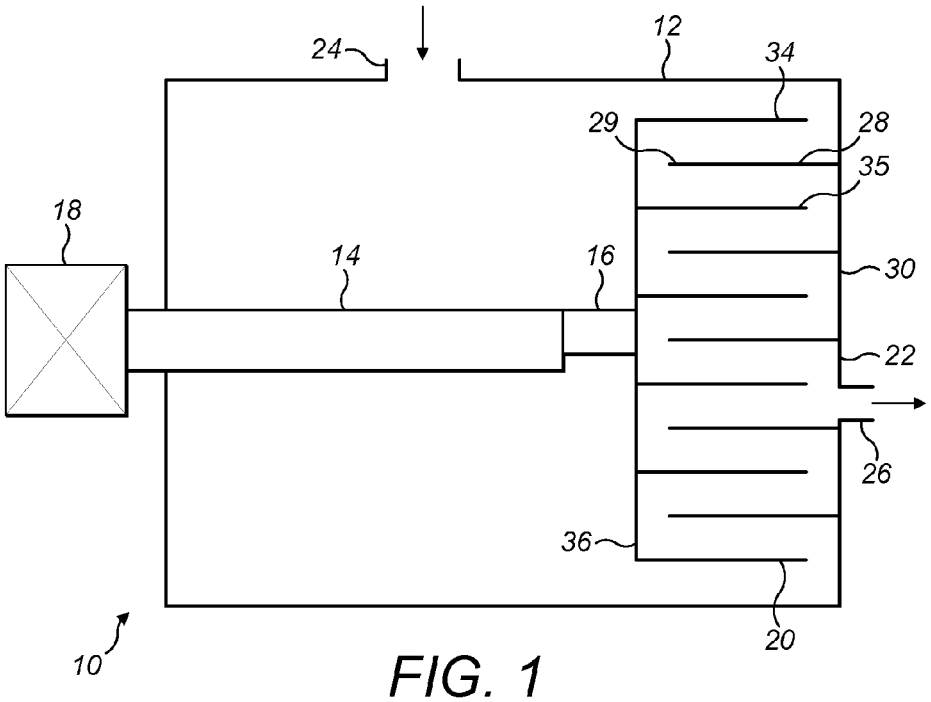
FIG. 1 is a schematic view of a scroll pump.

A scroll compressor, or pump, 10 is shown in FIG. 1. The pump 10 comprises a pump housing 12 and a drive shaft 14 having an eccentric shaft portion 16. The shaft 14 is driven by a motor 18 and the eccentric shaft portion is connected to an orbiting scroll 20 so that during use rotation of the shaft imparts an orbiting motion to the orbiting scroll relative to a fixed scroll 22 for pumping fluid along a fluid flow path between a pump inlet 24 and pump outlet 26 of the compressor.

The fixed scroll 22 comprises a scroll wall 28 which extends perpendicularly to a generally circular base plate 30. The orbiting scroll 20 comprises a scroll wall 34 which extends perpendicularly to a generally circular base plate 36. The orbiting scroll wall 34 co-operates, or meshes, with the fixed scroll wall 28 during orbiting movement of the orbiting scroll. Relative orbital movement of the scrolls causes a volume of gas to be trapped between the scrolls and pumped from the inlet to the outlet.

Figure 2:
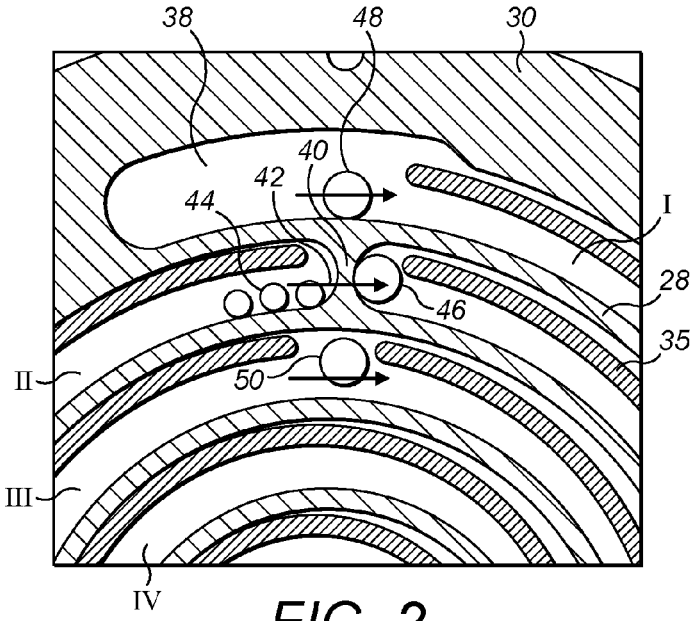
Figure 9:
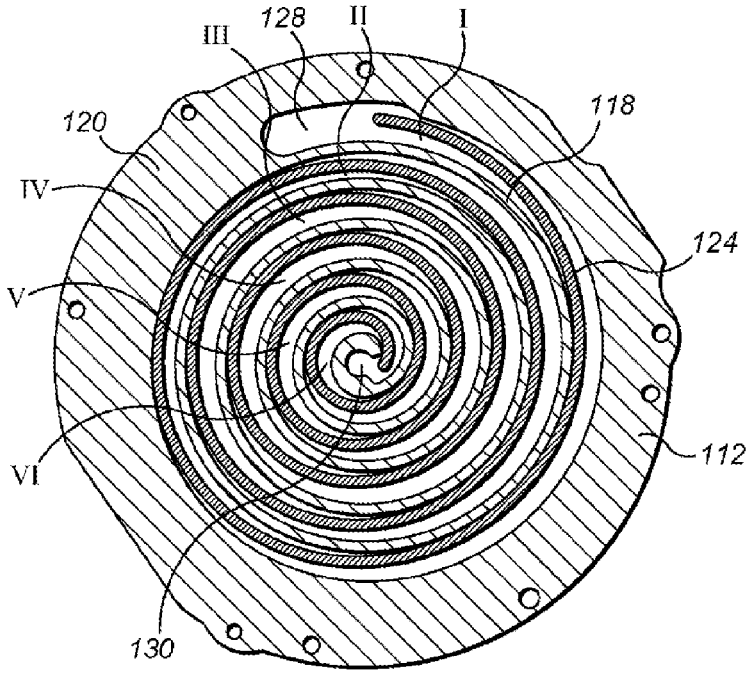
FIG. 9 PRIOR ART
FIG. 9 shows one scroll arrangement of the prior art pump.
Figure 10:
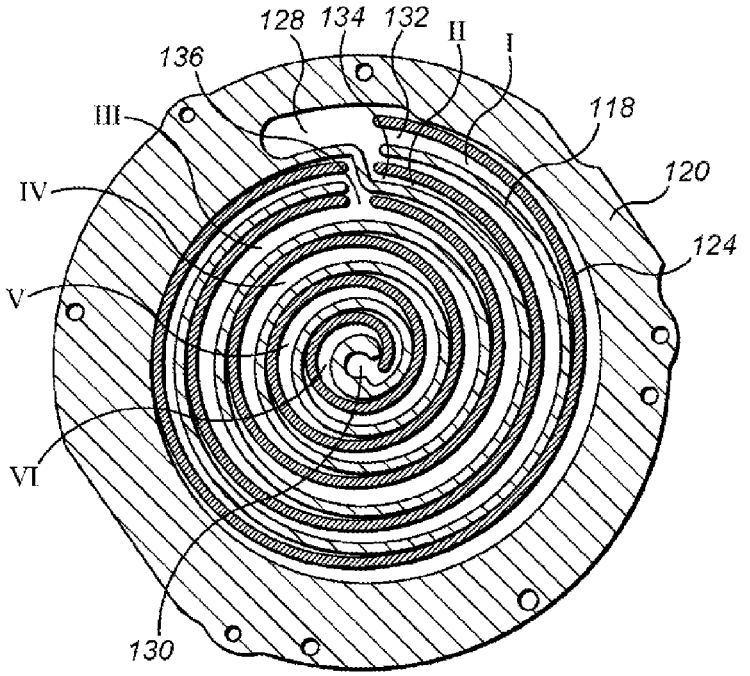
FIG. 10 PRIOR ART
FIG. 10 shows another scroll arrangement of the prior art pump.

FIGS. 2 and 3 show a modification to the scroll arrangements shown in prior art FIGS. 9 and 10. On relative orbital movement of the intermeshing scrolls 20, 22 gas is pumped from an inlet 38 of the scroll arrangement to an outlet (not shown, although is similarly configured to the outlet of the scroll arrangement described in FIGS. 9 and 10. The scroll inlet 38 receives fluid from the pump inlet 24 and the scroll outlet exhausts compressed fluid to the pump outlet 26. The scrolls 20, 22 have a plurality of successive scroll wraps between the inlet 24 and the outlet. Only wraps I, II, III, IV are shown in FIGS. 2 and 3. Wraps V and VI are not shown. Therefore this configuration has six wraps although the pump may have any numbers of scroll wraps more than two.

In FIG. 2, the scroll pump is in a single-start condition in which fluid is pumped from the inlet 38 to the outlet along a single flow path extending through each of the scroll wraps I, II, III, IV, V, VI in succession. In FIG. 3, the scroll pump is in a multi-start condition in which fluid is pumped from the inlet 38 along a plurality of flow paths which extend in parallel through radially adjacent scroll wraps I, II and converge to a single flow path prior to the outlet. A valve arrangement, which is described in more detail below, is operable for switching the scroll pump between the single-start and the multi-start conditions.

In the single-start condition shown in FIG. 2, the single flow path extends through each scroll wrap in succession. There is at least one interruption 40 in one of the scroll wraps for preventing fluid flow. In this example, the interruption 40 is a transverse wall which extends generally radially from the inner and outer fixed scroll walls of the second wrap II. The transverse wall has arcuate upstream and downstream surfaces which are swept by the orbiting scroll wall of the second wrap in order that a small clearance may be maintained between the scroll wall and transverse wall during relative orbiting movement. In other arrangements, and depending on the number of starts, there may be more than one interruption for preventing fluid flow in more than one scroll wrap. Although the transverse wall is shown on the fixed scroll, it may instead be provided on the orbiting scroll, or if there are more than two transverse walls one or more may be provided on one scroll and one or more may be provided on the other scroll.

At least one single-start transfer flow path (shown by arrow 42) conveys fluid across the interruption 40 and the valve arrangement (described below) is operable to direct fluid along the or each transfer flow path in the single-start condition. The single-start transfer flow path 42 extends from three inlet ports 44 on one (upstream) side of the interruption 40 to an outlet port 46 on the other (downstream) side of the interruption. The benefit of providing a plurality of inlet ports 44 is to improve compression of the pumped fluid and its transfer across the radial wall to port 46. However, a single inlet port may be adopted as an alternative.

The single-start transfer flow path 42 may be formed by a duct extending between the inlet ports 44 and the outlet ports 46 at least partially through the scroll plate 30, 36 of the relevant scroll. In one arrangement, the duct is formed wholly within the scroll plate. In another arrangement, bores may be made through the scroll plate and pipe-work connected to the through-bores at the back of the scroll plate to form the duct.

Two further ports 48, 50 are shown in the fixed scroll plate in FIG. 2. These further ports are not used in the single-start condition, and are functionally closed by the valve arrangement thereby resisting fluid flow into or out of the ports. Accordingly, in the single-start condition a single flow path is formed from the inlet 38 to the outlet of the scroll arrangement, the single-start transfer flow path 42 forming a portion of the spiral flow path.

In the multi-start condition shown in FIG. 3, a plurality of multi-start transfer flow paths, indicated by arrows 52, 54, convey fluid across the fixed scroll walls between respective adjacent scroll wraps. A first multi-start transfer flow path 52 conveys fluid across the fixed scroll wall 28 between wraps I and II, and a second multi-start transfer flow path 54 conveys fluid across the fixed scroll wall between wraps II and III. The valve arrangement is operable to direct fluid along said transfer flow paths in the multi-start condition. Accordingly, fluid passing through the inlet 38 is conveyed along a first fluid flow path, indicated by arrow 56, through the first wrap I and along a second fluid flow path through the second wrap II after it has passed along the first transfer flow path 52. Therefore, two flow paths extend from the inlet in parallel through radially adjacent scroll wraps I, II. The first flow path extends through approximately 360° and then passes along the second transfer flow path 54. The second flow path extends through approximately 360° and converges to a single flow path with the first flow path that has passed along the second transfer flow path. The single converged flow path then extends to the outlet along the rest of the wraps.

The multi-start transfer flow paths 52, 54 are formed by ducts extending through one or both of the scroll plates and in this example, the ducts are formed in the fixed scroll plate. The duct of transfer flow path 52 extends from the inlet port 48 in scroll wrap I to the outlet port 46 in the successive scroll wrap II. The duct of transfer flow path 54 extends from the inlet ports 44 in scroll wrap II to the outlet port 50 in the successive scroll wrap III.

Comparing FIGS. 2 and 3, it will be seen that the inlet ports 44 of the single-start transfer flow path 42 forms the inlet port of multi-start transfer flow path 54. Also, the outlet port 46 of the single-start transfer flow path forms the outlet port of the multi-start transfer flow path 52. Accordingly, in this example, the ducting of the single and multi-start transfer flow paths is at least partially co-extensive which allows the amount of machining required to produce the ducts to be reduced and also allows the arrangement of the valve described in detail below. In an alternative, the ducts of the single and multi-start transfer flow paths may be discrete and separate.

Referring to FIGS. 4 and 5, the valve arrangement 56 comprises a valve member 58 fitted for movement between a first position shown in FIG. 4 for allowing gas flow along the single-start transfer flow path 42 and resisting gas flow along the multi-start transfer flow paths 52, 54 in the single-start condition of the pump, and a second position shown in FIG. 5 for allowing gas flow along the multi-start transfer flow paths 52, 54 and resisting gas flow along the single-start transfer flow path 42 in the multi-start condition of the pump.

The valve member 58 is formed in this example by an elongate spool valve having three spools 60, 62, 64. The spool is fitted for longitudinal movement in a spool valve chamber 66. The spools are closely adjacent the spool valve chamber to reduce leakage. A controller 67 controls an actuator 69 for moving the valve back and forth in the chamber to slide the spools into different positions.

In the single-start condition shown in FIG. 4, the valve 58 is positioned by the controller so that the spools 62, 64 open the single-start transfer flow path 42 between ports 44 and port 46, and block fluid flow to or from ports 48 and 50. The single-start transfer flow path is formed by ducts 68, 70 and part of the spool valve chamber between spools 62 and 64. In the multi-start condition shown in FIG. 5, the valve 58 is positioned by the controller so that the spool 62 blocks fluid flow between the ports 44 and the port 46, and the spools 60, 64 open the multi-start transfer flow paths 52, 54 between port 48 and port 46 and ports 44 and 50, respectively. The multi-start transfer flow path 52 is formed by duct 70 and part of the spool valve chamber between spools 60 and 62. The multi-start transfer flow path 54 is formed by duct 68 and part of the spool valve chamber between spools 62 and 64. Therefore, the single-start transfer flow path and the multi-start transfer flow paths are partially co-extensive and the valve member is fitted for movement in the portions of the flow paths which are co-extensive.

Spool 60 is not required in this arrangement for directing fluid flow and is included to stabilize movement of the valve in the valve chamber. It can therefore be omitted. Other suitable valve arrangements will be apparent to those skilled in the art. For example a valve may be arranged to selectively block one of the two inlet channels in wraps I and II of a two-start pump. This embodiment could be achieved with a less complex valve, which would reduce the cost of implementation. Although this simplified approach would not deliver the superior ultimate pressure of a single start pump.

Figure 6:
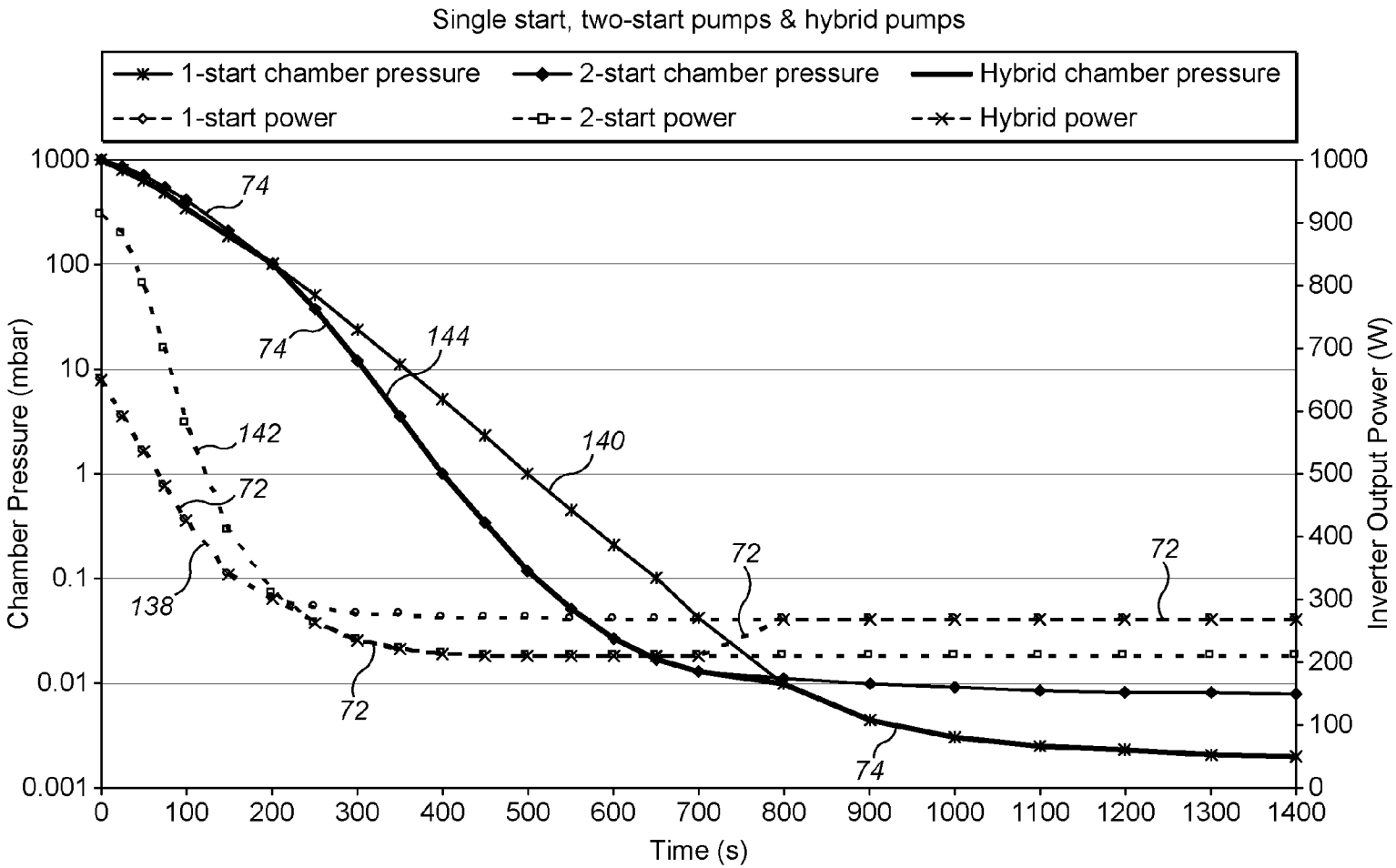
FIG. 6 is a graph showing characteristics of the scroll pump in use.
Figure 11:
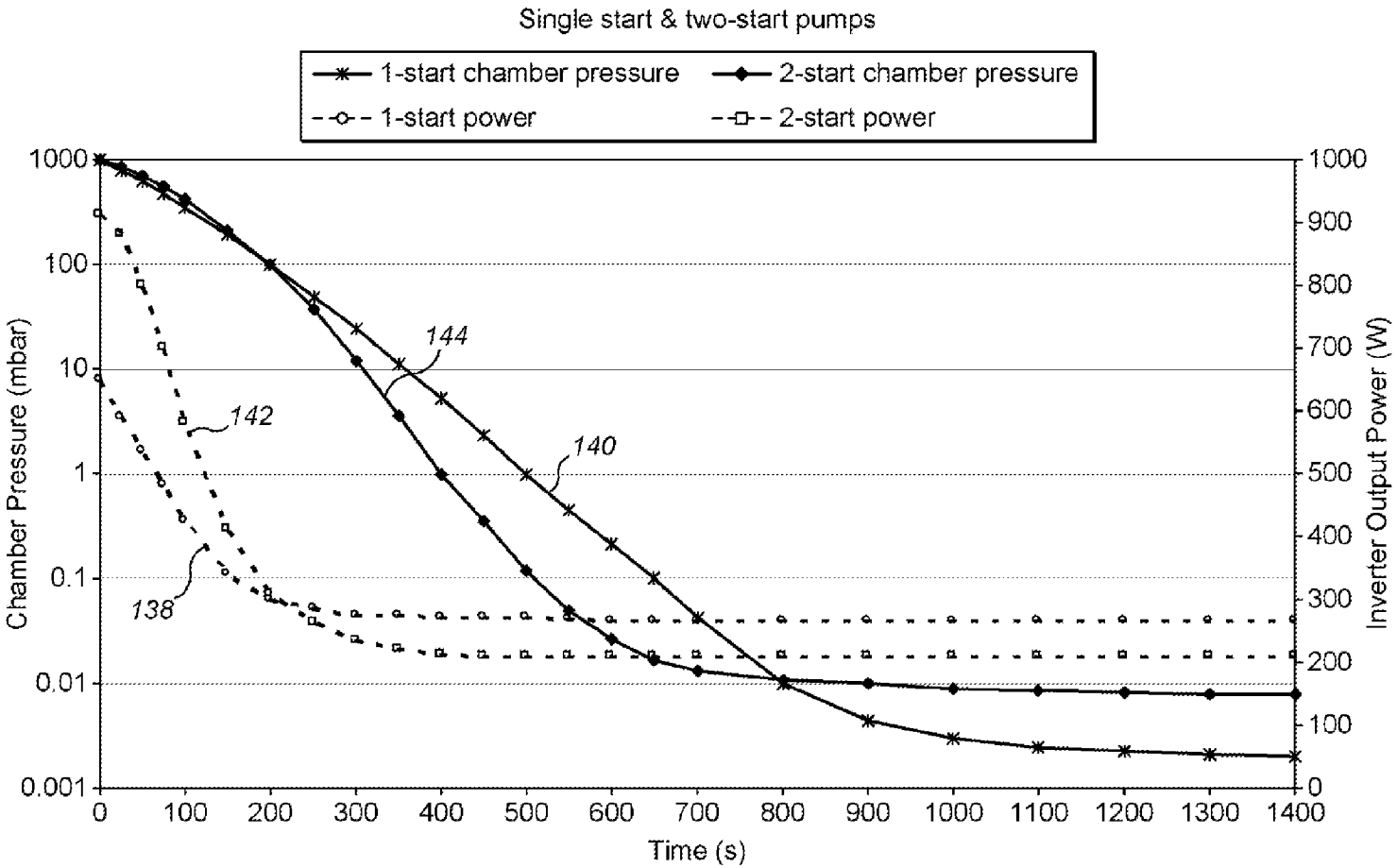
FIG. 11 PRIOR ART
FIG. 11 is a graph showing characteristics of the FIG. 9 and FIG. 10 scroll arrangements in use.

FIG. 6 is graph showing various characteristics of the present hybrid pump compared with the prior art single-start and twin-start arrangements discussed above in relation to FIG. 11. The graph shows chamber pressure on the left axis, inverter output power on the right axis and elapsed time on the horizontal axis. Inverter output power is power consumed by the pump. There are six curves shown in the graph; power consumed 138 and chamber pressure 140 for a single start arrangement and power consumed 142 and chamber pressure 144 for a two-start arrangement, and power consumed 72 and chamber pressure 74 for the hybrid pump. Power consumed is shown in broken lines and chamber pressure is shown in solid lines.

The single-start and two-start prior art pumps reduce pressure over an initial period to 100 mbar at a similar rate. However, the power consumed by the single-start pump is less than that of the two-start pump. Therefore, the hybrid pump adopts the single-start condition over this initial period for reduced power consumption. After the initial pressure decrease to 100 mbar, the two-start pump reduces pressure at a faster rate than the single-start arrangement. Therefore, the hybrid pump adopts the multi-start arrangement during evacuation of the chamber from about 100 mbar to about 0.01 mbar. It will be seen that the single-start pump can achieve a lower ultimate pressure of 0.005 mbar but with more power consumption than the two-start pump which achieves 0.01 mbar at ultimate with lower power consumption. Accordingly, below 0.01 mbar the hybrid pump can be arranged to adopt the single-start arrangement or the two-start arrangement, depending on the user's requirements, for example if the user requires a lower ultimate pressure or reduced power consumption.

The switching between single-start and multi-start condition may be performed manually by an operative who is monitoring the pump. Alternatively, one or more sensors may output one of pressure level, pressure gradient, power level, power gradient or any other suitable pump characteristic to the pump control for activating switching between conditions.

The above operation of the hybrid pump is only one of the ways in which the hybrid pump can be operated. For example, a pump operative may consider that conservation of power is most desirable. Alternatively, the operative may be more concerned with rate of pressure reduction that ultimate pressure. Accordingly, in its most general sense, the hybrid pump can be operated for controlling operation of the valve arrangement dependent on any one or more characteristics of the pump, including without limitation power, rate of pressure reduction and ultimate pressure. It would also be possible to provide pre-programmed operation modes to achieve, for example, fastest pump down, lowest power, best ultimate, longest tip seal life and other modes specified or programmed by the user.

Figure 7:
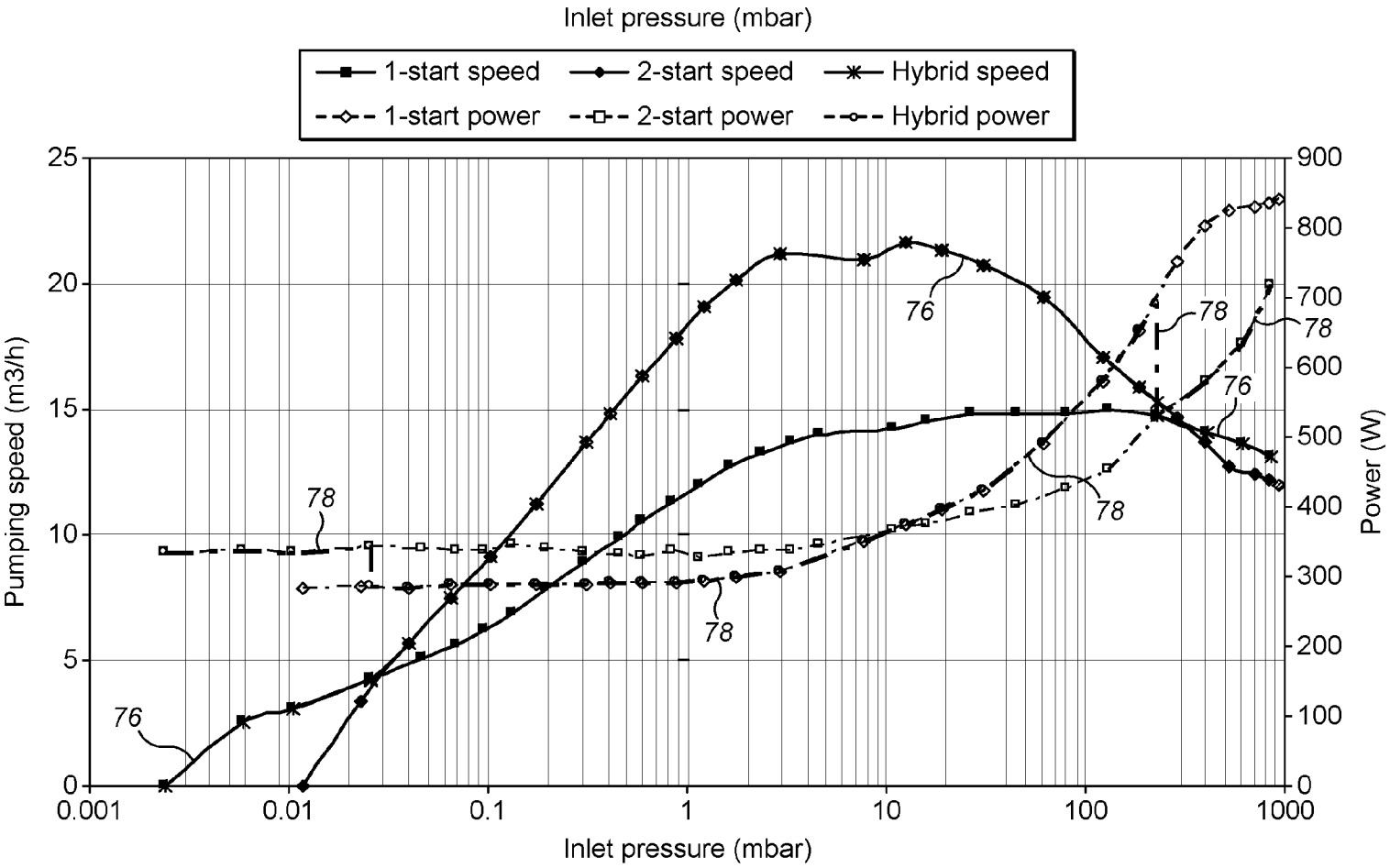
FIG. 7 is a showing other characteristics of the scroll pump in use.
Figure 8:
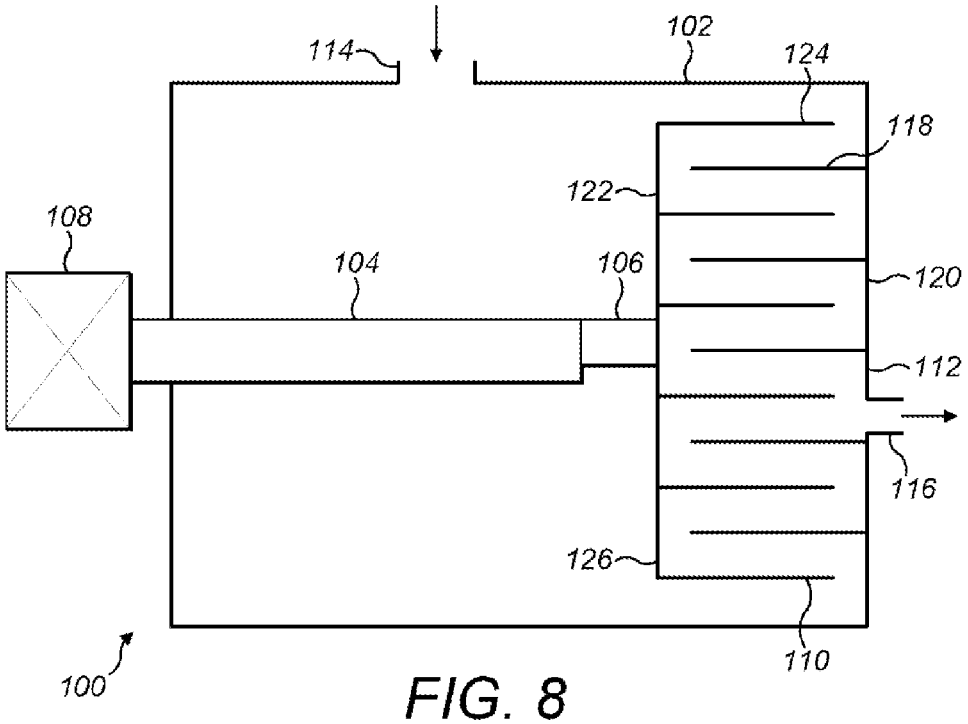
FIG. 8 PRIOR ART
FIG. 8 is a prior art scroll pump.

FIG. 7 is a graph showing inlet pressure on the horizontal axis, pumping speed on the left vertical axis and power on the right vertical axis. Although the pumping speed and power for the prior art single-start and two-start pumps are shown, only the pumping speed 76 and power 78 for the hybrid pump in this mode of operation are labeled. In this example, pumping speed is considered to be the most important characteristic and therefore at any point of the graph at which the pumping speeds curves for the prior art pumps cross each other, the controller selects operation in either the single-start or multi-start condition to achieve the greatest pumping speed. It will be appreciated from this graph that if power consumption were considered more important the pump control would operate the pump in different conditions to achieve a reduction in power. The control may be configured prior to pump delivery to the customer for increasing a particular characteristic. Alternatively, the control may be configured to receive an input from a customer for selecting any desired characteristic either before use or during use.

The present embodiment is operative in a single-start condition or a multi-start condition. The term multi-start means two or more starts. Additionally, the pump can be configured to be operative in more than two conditions, for example, a single-start condition, a two-start condition and a three-start condition (or even more such conditions as required). If the pump were configured for a three-start condition, two single-start transfer flow paths would be required and three multi-start transfer flow paths would be required. These flow paths may be formed in one or both of the scroll plates. Further, in some applications, for example where ultimate pressure is not considered to be the most important characteristic, the pump may be configured without a single-start condition. In this regard, there may be a two-start condition and a three-start condition or any combination of multi-start conditions. In such a two-start/three-start arrangement, the single-start transfer flow path referenced 42 in the description of the earlier embodiment will not be required. The first two wraps in this arrangement will be similar to the prior art two-start arrangement shown in FIG. 10, and there may be porting from the second wrap II to the third wrap III for selectively operating the pump in the three-start configuration.

The invention claimed is:

1. A vacuum scroll pump comprising:

a first scroll intermeshing with a second scroll and arranged so that, on relative orbital movement of the scrolls, fluid is pumped from an inlet of the scroll pump to an outlet of the scroll pump, wherein each of the first and second scrolls comprises a respective plurality of successive scroll wraps between the inlet and the outlet;

a single-start condition in which fluid is pumped from the inlet to the outlet along a single flow path extending through each of the scroll wraps of the first scroll in succession;

a multi-start condition in which fluid is pumped from the inlet along a plurality of flow paths which extend in parallel through radially adjacent scroll wraps of the first scroll and converge to a single flow path prior to the outlet; and a valve arrangement operable for switching the scroll pump between the single-start and the multi-start conditions.

2. The vacuum scroll pump of claim 1, wherein:

the single flow path extending through each of the scroll wraps of the first scroll in succession includes at least one interruption for preventing fluid flow;

the scroll pump further comprises at least one single-start transfer flow path for conveying fluid across the interruption; and the valve arrangement is operable to direct fluid along the at least one single-start transfer flow path in the single-start condition.

3. The vacuum scroll pump of claim 2, further comprising a plurality of multi-start transfer flow paths for conveying fluid across scroll walls between respective adjacent scroll wraps of the first scroll, the valve arrangement being operable to direct fluid along the plurality of multi-start transfer flow paths in the multi-start condition.

4. The vacuum scroll pump of claim 3, wherein each of the two intermeshing scrolls comprises a respective scroll plate, and wherein the single-start transfer flow path and the multi-start transfer flow paths are respectively formed by ducts extending through one or both of the respective scroll plates.

5. The vacuum scroll pump of claim 4, wherein the single-start transfer flow path extends from an inlet port on one side of the interruption to an outlet port on the other side of the interruption.

6. The vacuum scroll pump of claim 5, wherein each of the multi-start transfer flow paths extends from an inlet port in one of the respective plurality of successive scroll wraps of the first scroll to an outlet port in a successive wrap of the respective plurality of successive scroll wraps of the first scroll.

7. The vacuum scroll pump claim 6, wherein the inlet port of the single-start transfer flow path forms the inlet port of one of the multi-start transfer flow paths and the outlet port of the single-start transfer flow path forms the outlet port of another one of the multi-start transfer flow paths.

8. The vacuum scroll pump of claim 7, wherein the valve arrangement comprises a valve member fitted for movement between a first position that allows gas flow along the single-start transfer flow path and resists gas flow along the multi-start transfer flow paths in the single-start condition of the pump, and a second position that allows gas flow along the multi-start transfer flow paths and resists gas flow along the single-start transfer flow path in the multi-start condition of the pump.

9. The vacuum scroll pump of claim 8, wherein at least a portion of the single-start transfer flow path and at least a portion of at least one of the multi-start transfer flow paths are partially co-extensive and the valve member is fitted for movement in the portion of the flow paths which are co-extensive.

10. The vacuum scroll pump of claim 4, wherein each of the multi-start transfer flow paths extends from an inlet port in one of the respective plurality of successive scroll wraps of the first scroll to an outlet port in a successive wrap of the respective plurality of successive scroll wraps of the first scroll.

11. The vacuum scroll pump of claim 1, further comprising a plurality of multi-start transfer flow paths for conveying fluid across scroll walls between respective adjacent scroll wraps of the first scroll, the valve arrangement being operable to direct fluid along the plurality of multi-start transfer flow paths in the multi-start condition.

12. The vacuum scroll pump of claim 1, further comprising a controller configured to control operation of the valve arrangement dependent on one or more characteristics of the pump.

13. The vacuum scroll pump of claim 12, wherein the pump characteristics include one or more of power consumption, rate of power consumption change, pressure, or rate of pressure change.

14. The vacuum scroll pump of claim 13, wherein the controller is configured to select operation of the scroll pump in the single-start condition or the multi-start condition at any given pressure dependent on the rate of pressure reduction achieved in the single-start condition or the multi-start condition.

15. The vacuum scroll pump of claim 14, wherein the controller is configured to select operation of the scroll pump in the single-start condition or the multi-start condition at any given pressure dependent on the power consumed by the scroll pump at that pressure in the single-start condition or the multi-start condition.

16. The vacuum scroll pump of claim 13, wherein the controller is configured to select operation of the scroll pump in the single-start condition or the multi-start condition at any given pressure dependent on the power consumed by the scroll pump at that pressure in the single-start condition or the multi-start condition.

17. A vacuum scroll pump comprising:

a first scroll intermeshing with a second scroll and arranged so that, on relative orbital movement of the scrolls, fluid is pumped from an inlet of the scroll pump to an outlet of the scroll pump, wherein each of the first and second scrolls comprises a respective plurality of successive scroll wraps of the first scroll between the inlet and the outlet;

a first multi-start condition in which fluid is pumped from the inlet along a first plurality of flow paths which extend in parallel through radially adjacent scroll wraps of the first scroll and converge to a single flow path prior to the outlet;

a second multi-start condition in which fluid is pumped from the inlet along a second plurality of flow paths which extend in parallel through radially adjacent scroll wraps of the first scroll and converge to a single flow path prior to the outlet, wherein the number of starts in the first multi-start condition is different from the number of starts in the second multi-start condition; and a valve arrangement operable for switching the scroll pump between the first and the second multi-start conditions.

* * * * *